US006286501B1

(12) United States Patent
Charland

(10) Patent No.: US 6,286,501 B1
(45) Date of Patent: Sep. 11, 2001

(54) HUMIDIFIER SYSTEM

(76) Inventor: Gerard Charland, 532 Adams St., PMB 171, Milton, MA (US) 02186

( * ) Notice: Subject to any disclaimer, the term of this patent is extended or adjusted under 35 U.S.C. 154(b) by 0 days.

(21) Appl. No.: 09/353,759

(22) Filed: Jul. 14, 1999

(51) Int. Cl.[7] ..... F24H 3/14

(52) U.S. Cl. ..... 126/113; 126/110 R; 165/222; 165/921

(58) Field of Search ..... 126/113, 110 R, 126/101, 99 R; 165/201, 222, 96, 921; 237/78, 9 R, 63, 67; 261/141, DIG. 15

(56) References Cited

U.S. PATENT DOCUMENTS

| | | | | |
|---|---|---|---|---|
| Re. 34,739 | | 9/1994 | Nelson et al. | 126/113 |
| 1,425,608 | * | 8/1922 | Sallada | 126/113 |
| 1,641,587 | * | 9/1927 | Hilty | 126/113 |
| 2,069,145 | | 1/1937 | Hastings et al. | 122/451 |
| 3,294,081 | | 12/1966 | Zach | 126/113 |
| 3,303,837 | * | 2/1967 | Rither | 126/113 |
| 3,305,173 | * | 2/1967 | Beckman | 126/113 |
| 3,824,985 | | 7/1974 | Hetherington | 126/113 |
| 4,256,081 | | 3/1981 | Stover | 126/101 |
| 4,257,389 | | 3/1981 | Texidor et al. | 126/113 |
| 4,825,847 | | 5/1989 | Perron | 126/113 |
| 5,570,680 | | 11/1996 | Payne | 126/113 |

* cited by examiner

*Primary Examiner*—James C. Yeung
(74) *Attorney, Agent, or Firm*—Pandiscio & Pandiscio

(57) ABSTRACT

A humidifier for adjusting the humidity level in a building, the humidifier having a heat exchange tube adapted to be heated by a furnace as the furnace heats air to be circulated through the building; an evaporation tube, in fluid communication with the heat exchange tube, adapted to maintain fluid at a first level when the furnace is not heating air; and a purge line in fluid communication with the evaporation tube, the purge line being adapted to drain fluid from the humidifier when the furnace is heating air and the fluid is at a second level.

17 Claims, 1 Drawing Sheet

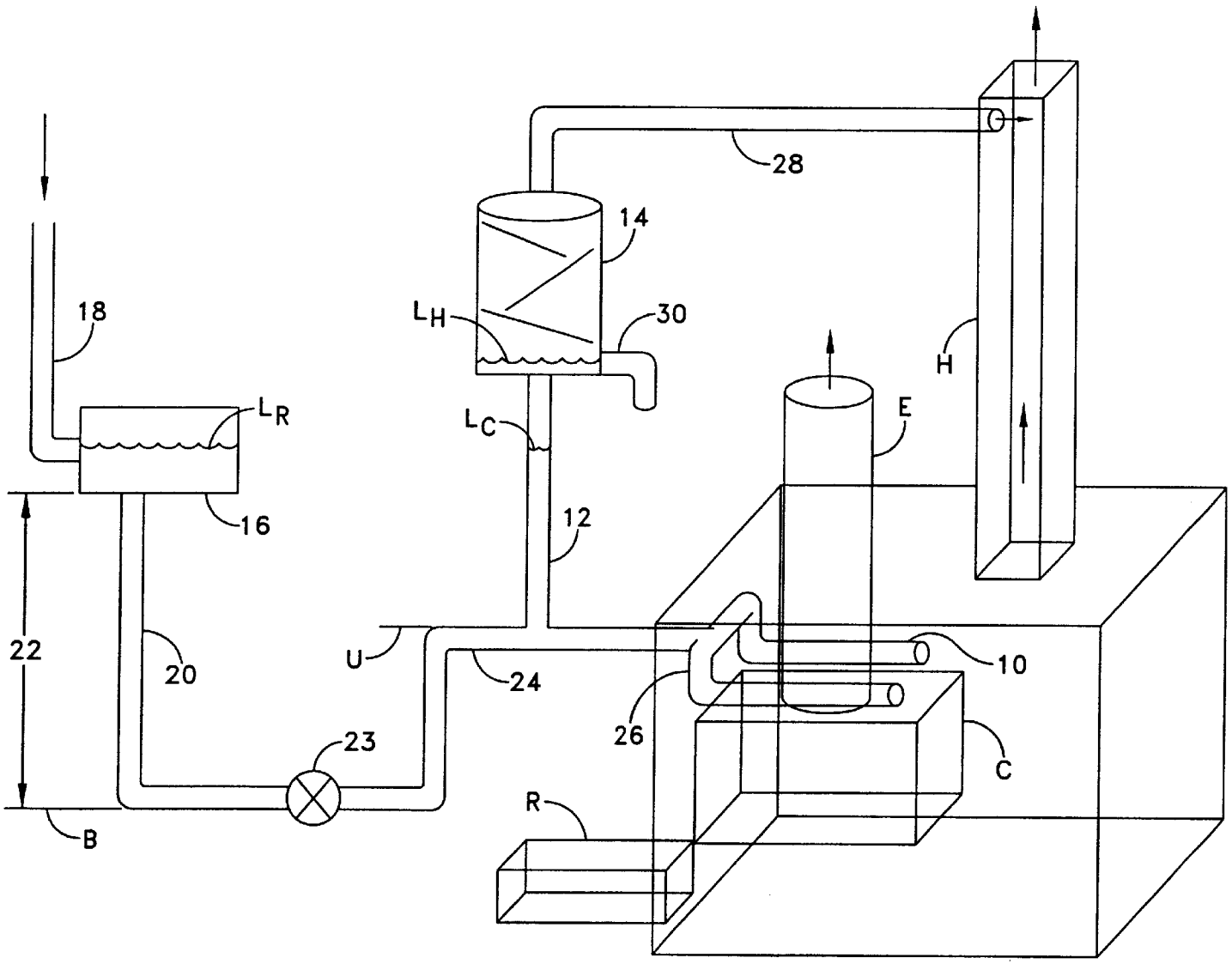
H
E
10
C
28
30
14
12
26
R
24
$L_C$
$L_H$
U
23
$L_R$
16
20
18
B
22

HUMIDIFIER SYSTEM

FIELD OF THE INVENTION

This invention relates to heating and humidifying a building, and more specifically, to adjusting the humidity in a building heated with forced hot air heating apparatus.

BACKGROUND OF THE INVENTION

When air is heated to make a building comfortable in cold weather, air in the building is dried out and has an adverse effect on anyone living or working in such atmosphere. For example, nose and throat membranes dry out, causing irritation and discomfort. Also, excess body moisture evaporation, caused by dry air, requires an even greater temperature level for comfort, thus compounding the problems involved. Inanimate objects, such as furniture and other wooden components of a building, shrink and crack and joints loosen, causing damage to the structure. A dry atmosphere also promotes creation of static electricity, which not only causes petty annoyances due to minor electrical shock episodes, but which may also cause damage to electronic equipment such as computers and the like.

To address these problems, many types of humidifying units have been proposed as stand-alone units or as part of building heating systems.

One example includes placing a container of water near a combustion chamber of a hot air furnace. Water evaporating from the warmed container is circulated through the ductwork of the hot air heating system throughout the building. However, this system creates two problems. First, standing water in the container, which is warmed but not sterilized, tends to promote the growth of bacteria or other pathogens which can make the human building inhabitants ill. Second, the humidity level in the building cannot be effectively controlled.

Some inventions employ the building furnace to boil water and introduce the steam generated into the heated air circulated throughout the building. Although some of these inventions allow for adjusting the overall humidity level within the building, such systems tend to require intricate humidity control circuits which regulate fluid pressure or fluid level within a boiler or heat-exchanging tubes which contain the fluid which is ultimately converted into steam.

Unfortunately, no existing humidifier or furnace system provides a simple mechanism for adjusting the humidity level in a building.

SUMMARY OF THE INVENTION

The invention is a humidifier that provides for adjusting the humidity level in a building. The invention discourages the growth of pathogens in the water vapor used to humidify buildings. The invention may be readily incorporated into any existing forced hot air heating system. The invention provides improved elements and arrangements thereof, in an apparatus and concomitant method for the purposes described, which are inexpensive, dependable and effective in accomplishing its intended purposes.

The invention introduces vapor into the forced hot air supply of a building in an amount related to the height of fluid in a reservoir which feeds the humidifier.

In a conventional oil or gas furnace system, an embodiment configured according to the principles of the invention includes fluid-filled heat exchange tubes that are heated by the furnace as the furnace heats air to be circulated through the building. The fluid is generally intended to be common tap water. However, the term "fluid" should not be interpreted to exclude other suitable liquids, e.g., the fluid might be distilled water, or water having a chemical or medication added to it, etc. A reservoir supplies the fluid to the heat exchange tubes. Between and in fluid communication with both the reservoir and the heat exchange tubes, an evaporation tube maintains a column of fluid at predetermined cold and hot levels above the heat exchange tubes. When the furnace is not operating, the fluid in the evaporation tube defines a cold fluid level that corresponds to a fluid level in the reservoir supplying fluid to the heat exchange tubes. When the furnace is operating, fluid in the heat exchange tubes boils, naturally rises above the cooler fluid in the evaporation tube, and defines a turbulent hot fluid level in a vertically-superior separator. The separator has a purge line that drains fluid from the separator when the hot fluid level is equal to or greater than the height of the purge line. Increasing the height of the fluid in the reservoir increases the height of the fluid in the evaporation tube, and hence increases the height of the turbulent hot fluid level in the separator; conversely, decreasing the height of the fluid in the reservoir decreases the height of the fluid in the evaporation tube, and hence decreases the height of the turbulent fluid level in the separator. Increasing the height of the hot fluid level over the purge line increases the amount of hot water that is drained from the separator. As fluid is drained from the separator, the reservoir refills the system with fluid at ambient temperature. As the reservoir refills the system with fluid at ambient temperature, cooler fluid flows into the evaporation tube, effectively reducing the temperature of the fluid therein. Cooling the temperature of the fluid in the evaporation tube reduces the amount of vapor generated in the evaporation tube, and thus the humidity of the building.

Accordingly, the humidity in the building corresponds to the fluid level in the reservoir; as the fluid level in the reservoir decreases, the humidity of the building increases, and as the fluid level in the reservoir increases, the humidity level of the building decreases.

These and other features of the invention will be appreciated more readily in view of the drawing and the detailed description set forth below.

BRIEF DESCRIPTION OF THE DRAWING

The invention is described in detail below with reference to the attached drawing, which is a schematic top, right, front representation of an embodiment of a heating-humidifying apparatus constructed according to principles of the invention.

DETAILED DESCRIPTION OF THE INVENTION

The invention is a humidifier for adjusting the humidity level in a building.

The invention introduces vapor into the forced hot air supply of a building in an amount related to the height of a fluid in a reservoir which feeds the humidifier.

In a conventional oil or gas furnace system, an embodiment configured according to the principles of the invention includes fluid-filled heat exchange tubes 10 heated by the furnace as the furnace heats air to be circulated through the building. As noted above, the fluid is preferably tap water, but also might comprise other suitable liquids, e.g., distilled water, water having a chemical or medication added thereto, etc. A reservoir 16 supplies the fluid to the heat exchange tubes 10. Between and in fluid communication with both the reservoir 16 and the heat exchange tubes 10, an evaporation tube 12 maintains a column of fluid at predetermined cold and hot levels above the heat exchange tubes 10. When the furnace is operating, fluid in the heat exchange tubes 10 boils, naturally rises above the cooler fluid in the evaporation tube 12 and defines a turbulent hot fluid level $L_H$ in a vertically-superior separator 14. Of course, in this respect it should be appreciated that inasmuch as the fluid level $L_H$ is defined by a turbulent, hot boiling fluid, the level $L_H$ is really something of an average height for the turbulent upper surface of the boiling water, i.e., at any given moment, at any given surface location, the fluid might actually be above or below $L_H$.

A purge line 30 drains fluid from the separator 14 when the hot fluid level $L_H$ is equal to or greater than the height of the purge line 30. Increasing the height of the fluid in reservoir 16 increases the height of the fluid in evaporation tube 12, and hence increases the height of the turbulent hot fluid level $L_H$ in separator 14; conversely, decreasing the height of the fluid in reservoir 16 decreases the height of the fluid in evaporation tube 12, and hence decreases the height of the turbulent fluid level $L_H$ in separator 14. Increasing the height of the hot fluid level $L_H$ over the purge line 30 increases the amount of hot water that is drained from the separator 14. As fluid is drained from the separator 14, the reservoir 16 refills the system with fluid at ambient temperature. As the reservoir 16 refills the system with fluid at ambient temperature, cooler fluid flows into the evaporation tube 12, effectively reducing the temperature of the fluid therein. Cooling the temperature of the fluid in the evaporation tube 12 reduces the amount of vapor generated in the evaporation tube 12, and thus the humidity of the building.

Accordingly, the humidity in the building corresponds to the fluid level in the reservoir; as the fluid level in the reservoir decreases, the humidity of the building increases, and as the fluid level in the reservoir increases, the humidity level of the building decreases.

Referring to the FIGURE, an embodiment of the invention is shown incorporated into a conventional forced hot air building heating system. The building heating system includes a combustion chamber C which heats air to be circulated through the building. The combustion chamber C may burn oil, gas or other suitable combustible. Noxious gases exit through an exhaust chimney E into the atmosphere. Warmed air is blown or otherwise directed through the hot air supply H. Cold air returns to the furnace for heating through cold air return R.

The heat exchange tubes 10 are positioned such that fluid contained therein boils when the furnace heats air to be circulated through a building. To that end, the heat exchange tubes 10 are located proximate to the combustion chamber C of the furnace. The heat exchange tubes 10 are capped at one end.

Preferably the reservoir 16 receives the fluid from a conventional fluid service 18 (i.e., water from a domestic water pipe) and supplies the fluid to the heat exchange tubes 10. Preferably, for a typical house, the reservoir 16 is approximately seven inches long by approximately six inches wide, with an approximately five-inch depth.

Between and in fluid communication with both the reservoir 16 and the heat exchange tubes 10, the evaporation tube 12 maintains a column of fluid at predetermined cold and hot levels above the heat exchange tubes 10. When the furnace is not operating, the fluid defines a cold fluid level $L_C$. The cold fluid level $L_C$ corresponds to the height of a fluid level $L_R$ established by the reservoir 16. When fluid in the heat exchange tubes 10 is heated, the fluid boils and naturally rises above cooler fluid in the evaporation tube 12. During steady-state furnace operation, the fluid exhibits vigorous boiling characteristics, such as rolling and bubbling, and the fluid level increases to a hot fluid level $L_H$ which is vertically superior to the cold fluid level $L_C$. As the fluid level increases, fluid passes from the evaporation tube 12 into the separator 14. Increasing the height $L_R$ of the fluid in reservoir 16 increases the height $L_C$ of the fluid in evaporation tube 12, and hence increases the height $L_H$ of the turbulent hot fluid level in separator 14; conversely, decreasing the height $L_R$ of the fluid reservoir 16 decreases the height $L_C$ of the fluid in evaporation tube 12, and hence decreases the height $L_H$ of the turbulent fluid level in separator 14.

The separator 14 includes a purge line 30 for draining fluid from the separator 14. Preferably, the purge line 30 always is open. The system is preferably configured so that purge line 30 always receives some amount of fluid while the furnace is actively heating the fluid. The amount of fluid received in the purge line 30 depends on the hot fluid level $L_H$. Increasing the hot fluid level $L_H$ relative to the purge line 30 increases the amount of fluid received in the purge line 30, while decreasing the hot fluid level $L_H$ relative to the purge line 30 decreases the amount of fluid received in the purge line 30.

The reservoir 16 supplies fluid to the heat exchange tubes through a series of fluid conduits. The reservoir 16 discharges fluid through a reservoir output 20 that extends vertically downwardly to a base level B. Preferably, the distance 22 between the reservoir 16 and the base level B is approximately two feet. The reservoir output 20 terminates at a check valve 23. The check valve 23 permits fluid to flow from the reservoir output 20 to a fluid supply 24 and prohibits flow in the opposite direction. The fluid supply 24 extends from the check valve 23 and delivers fluid to the evaporation tube 12. The fluid supply 24 rises to an upper level U which, preferably, is approximately one foot above the base level B.

The heat exchange tubes 10 are connected to the fluid supply 24, and thus the evaporation tube 12, with risers 26. In a typical domestic gas-fired furnace, the risers 26 are preferably substantially vertical and extend for approximately seven inches. In a typical domestic oil-fired furnace, the risers 26 preferably rise at approximately a 22 degree angle with respect to the heat exchange tubes 10 and extend for approximately six inches.

In operation, when the furnace is combusting oil or gas, heating air to be circulated throughout the building, heat from the combustion chamber C heats the heat exchange tubes 10 such that fluid (i.e., water) in the heat exchange tubes 10 boils. As is understood from conventional laws of physics, the heated fluid is lighter than ambient fluid, and thus rises up from the heat exchange tubes 10 through the risers 26, through the fluid supply 24, and into the evaporation tube 12. As the fluid (i.e., water) continues to heat, the top surface of the fluid rises from its normal level $L_C$ (which is the same as the level $L_R$ in reservoir 16) to its turbulent hot fluid level $L_H$ which is within separator 14. Fluid (i.e., water) evaporates into vapor (i.e., water vapor) from the top surface of the fluid. Vapor passing through the separator 14 and received in the hot air supply H mixes with the dry air flowing therethrough and is circulated throughout the building, thereby increasing the humidity thereof.

The boiling fluid from the heat exchange tubes defines the turbulent hot fluid level $L_H$ in the separator 14. When the turbulent hot fluid level $L_H$ is approximately at the level of the purge line 30, relatively little hot water is drained from the separator 14. Increasing the turbulent hot fluid level $L_H$ above the level of the purge line 30 increases the amount of hot water drained from the separator 14 by purge line 30. As hot water is drained, the reservoir 16 replenishes the system, notably the fluid (i.e., water) in evaporator tube 12, with fluid at ambient temperature, thereby effectively reducing the temperature of the fluid therein. Reducing the temperature of the fluid in evaporator tube 12 reduces the potential for the fluid to vaporize. Reducing the vapor potential of the vapor diminishes the amount of vapor generated that may be introduced into the building.

Thus it will be seen that maintaining the turbulent hot fluid level $L_H$ approximately at or below the purge line 30 increases the vapor potential of the fluid and the amount of vapor generated, and thus the humidity in the building.

As noted above, the system is preferably configured so that purge line 30 always receives some amount of fluid while the furnace is actively heating the fluid. The amount of fluid increases when the turbulent hot fluid level $L_H$ rises relative to the purge line. By way of example but not limitation, in the case of a typical single family residential forced hot air heating system, when the system is set to yield a humidity of approximately 38–40%, the reservoir fluid level $L_R$ might be at some height X inches, and purge line 30 might yield approximately 12 ounces of fluid during a typical 12 minute active burner cycle; when the system is set to yield a humidity of approximately 45–48%, the reservoir fluid level $L_R$ might be at some height (X−½) inches, and purge line 30 might yield approximately 4–5 ounces of fluid during a typical 12 minute active burner cycle; and when the system is set to yield a humidity of approximately 33–35%, the reservoir fluid level might be at some height (X+½) inches and purge line 30 might yield approximately 24 ounces of fluid during a typical 12 minute active burner cycle.

The turbulent hot fluid level $L_H$ varies according to the cold fluid level $L_C$. For example, increasing the cold fluid level $L_C$ results in a comparable increase in the hot fluid level $L_H$ when the furnace is heating.

The cold fluid level $L_C$ depends on the reservoir fluid level $L_R$. For example, increasing the reservoir fluid level $L_R$ results in a comparable increase in the cold fluid level $L_C$.

Accordingly, increasing the reservoir fluid level $L_R$ results in a comparable increase in the hot fluid level $L_H$. Since decreasing the hot fluid level $L_H$ increases the amount of vapor generated and blown into a building (see above), decreasing the reservoir fluid level $L_R$ results in increasing the humidity of the building. Thus, the humidity of the building may be regulated simply by regulating the height of the fluid in reservoir 16.

The reservoir fluid level $L_R$ may be adjusted in at least two ways. One way is to alter the amount of fluid (i.e., water) contained in the reservoir 16. Adding fluid to the reservoir 16 increases the fluid level $L_R$ in the reservoir 16. Withdrawing fluid from the reservoir 16 decreases the fluid level $L_R$ in the reservoir 16.

Another way to adjust the fluid level $L_R$ is to alter the vertical relationship of the reservoir 16 relative to the heat exchange tubes 10, leaving unchanged the amount of fluid in the reservoir 16. Raising the reservoir 16, while maintaining the amount of fluid therein, effectively raises the fluid level $L_R$ relative to the heat exchange tubes 10. Lowering the reservoir 16, while maintaining the amount of fluid therein, effectively lowers the fluid level $L_R$ relative to the heat exchange tubes 10.

The separator 14 also separates condensed droplets from the water vapor prior to entry of the water vapor into the hot air supply H via the vapor output 28. The separator 14 may include plates on which the low-energy vapor condenses. The condensate drops from the plates back into the evaporation tube 12.

It should be appreciated that, inasmuch as the system generates water vapor only when the water contained in evaporation tube 12 is boiling, the water vapor entering hot air supply H is completely sterilized and free from pathogens.

The invention provides many important features. One feature is the introduction of sterilized water vapor into the living environment in which humans reside, which reduces the potential for sickness caused by airborne pathogens. Another feature is the ability to infinitely adjust the humidity level of a building for a desired comfort level. Yet another feature is excellent reliability, since the system does not rely on moving parts or sophisticated electronics.

The invention is not limited to the foregoing, but also encompasses all improvements and substitutions consistent with the principles of the invention.

What is claimed is:

1. A humidifier comprising:

a heat exchange tube adapted to be heated by a furnace as the furnace heats air to be circulated through a building;

an evaporation tube, in fluid communication with said heat exchange tube, adapted to maintain fluid at a first level when the furnace is not heating air; and a purge line in fluid communication with said evaporation tube, said purge line being adapted to drain fluid from said humidifier when said furnace is heating air and said fluid is at a second level.

2. The humidifier of claim 1, including a reservoir adapted to maintain fluid at a third level in fluid communication with said evaporation tube.

3. The humidifier of claim 2, wherein said first level corresponds to said third level.

4. The humidifier of claim 2, including a check valve regulating fluid flow between said reservoir and said heat exchange tube or said evaporation tube.

5. The humidifier of claim 2, further comprising means for adjusting said third level within said reservoir.

6. The humidifier of claim 2, further comprising means for adjusting a vertical relationship of said reservoir relative to said heat exchange tube, thereby adjusting said third level.

7. The humidifier of claim 1, including a separator in fluid communication with said evaporation tube and adapted to separate condensate from the vapor.

8. The humidifier of claim 7, said separator being adapted to return condensate to said evaporation tube.

9. The humidifier of claim 7, wherein said purge line is in fluid communication with said separator.

10. The humidifier of claim 1, including:

a fluid supply between said heat exchange tube and said evaporation tube; and a riser between said heat exchange tube and said fluid supply.

11. The humidifier of claim 10, wherein said fluid supply is vertically superior to a base level by one foot.

12. The humidifier of claim 11, including a reservoir adapted to maintain fluid at a third level in fluid communication with said evaporation tube;

wherein said reservoir is vertically superior to the base level by two feet.

13. The humidifier of claim 10, wherein said riser is generally vertical.

14. The humidifier of claim 13, said riser extending six or seven inches.

15. The humidifier of claim 10, wherein said riser rises at a generally 22 degree angle relative to said heat exchange tube.

16. The humidifier of claim 1, wherein said purge line has a level vertically equal to or less than the second level.

17. A method for adjusting the humidity of a building comprising:

positioning a heat exchange tube in a furnace so that the furnace heats the heat exchange tube when the furnace heats air to be circulated through the building;

maintaining a column of fluid in fluid communication with the heat exchange tube; and adjusting a temperature of the fluid in the column while the furnace is heating air corresponding to a desired humidity level;

said maintaining including controlling a reservoir fluid level; and including adjusting a vertical relationship of the reservoir relative to the heat exchange tube, thereby adjusting the reservoir fluid level.

* * * * *